US011293189B2

(12) United States Patent
Meyers et al.

(10) Patent No.: US 11,293,189 B2
(45) Date of Patent: Apr. 5, 2022

(54) FLOORING SYSTEM FOR USE IN A SLOPED FLOOR

(71) Applicant: EBBE AMERICA, LC, Clearfield, UT (US)

(72) Inventors: Alden S. Meyers, Clearfield, UT (US); Lawrence G. Meyers, Clearfield, UT (US)

(73) Assignee: Ebbe America LC, Clearfield, UT (US)

( * ) Notice: Subject to any disclaimer, the term of this patent is extended or adjusted under 35 U.S.C. 154(b) by 276 days.

(21) Appl. No.: 16/735,998

(22) Filed: Jan. 7, 2020

(65) Prior Publication Data

US 2020/0224432 A1 Jul. 16, 2020

Related U.S. Application Data

(60) Provisional application No. 62/791,990, filed on Jan. 14, 2019.

(51) Int. Cl.
*E04F 15/02* (2006.01)
*A47K 3/28* (2006.01)

(52) U.S. Cl.
CPC .... *E04F 15/02194* (2013.01); *E04F 15/0215* (2013.01); *A47K 3/283* (2013.01); *E04F 15/02188* (2013.01)

(58) Field of Classification Search
CPC ..... E04F 15/02188; E04F 15/0215; E04F 15/02194; A47K 3/283
See application file for complete search history.

(56) References Cited

U.S. PATENT DOCUMENTS

| | | | | |
|---|---|---|---|---|
| 5,140,789 | A * | 8/1992 | De Gooyer | A47K 3/40 4/613 |
| 9,848,742 | B2 * | 12/2017 | Phillips | B25B 13/48 |
| 10,383,484 | B2 * | 8/2019 | Fraga | A47K 3/40 |
| 10,870,977 | B2 * | 12/2020 | Meyers | E03F 5/041 |
| 10,988,919 | B2 * | 4/2021 | Self | E03C 1/20 |
| 2006/0101777 | A1 * | 5/2006 | Lapointe | E04D 13/1693 52/404.1 |
| 2006/0213006 | A1 * | 9/2006 | Rush | A47K 3/40 4/613 |
| 2008/0189926 | A1 | 8/2008 | Luxton | |
| 2010/0000169 | A1 * | 1/2010 | Grave | A47K 3/40 52/302.1 |
| 2011/0088160 | A1 * | 4/2011 | Stimpson | A47K 3/40 4/613 |
| 2015/0240504 | A1 * | 8/2015 | Hoffman | E04F 21/22 29/244 |
| 2016/0273233 | A1 * | 9/2016 | Pekovsek | E04F 11/002 |
| 2018/0110379 | A1 | 4/2018 | Wadaga | |
| 2018/0371763 | A1 * | 12/2018 | Stuchell | E04F 15/206 |
| 2019/0117040 | A1 * | 4/2019 | Knight | B32B 7/12 |
| 2019/0284818 | A1 * | 9/2019 | Penland, Jr. | E01C 5/20 |
| 2020/0340255 | A1 * | 10/2020 | Weller | E04F 15/02188 |

* cited by examiner

*Primary Examiner* — Paola Agudelo
(74) *Attorney, Agent, or Firm* — Workman Nydegger

(57) ABSTRACT

A flooring system includes a gridwork having a modular configuration that defines a grid with cells for receiving a filler material which forms a bed or floor base sloping toward a drain fixture. The gridwork includes different groupings of leveling holes located at selected junctions between adjacent cells that are arranged to selectively move or tilt the gridwork relative to an underlying base in conjunction with the formation of the bed or floor base.

20 Claims, 4 Drawing Sheets

FLOORING SYSTEM FOR USE IN A SLOPED FLOOR

TECHNICAL FIELD

The disclosure relates to a flooring system for use in a sloped floor.

BACKGROUND

Bathrooms, showers, and kitchens are often provided with tiled floors. In showers, a drain is typically placed in or near the center of the shower and the floor is sloped slightly towards the drain to ensure that water runs into the drain as opposed to sitting on the floor or seeping into the structure of or proximate the shower, e.g. at the floor beneath the shower. As can be appreciated, constructing a tiled floor that slopes in one or more directions towards the drain can be difficult and time consuming especially if localized reversed slopes and other slope anomalies are to be avoided. For instance, it is an installer's responsibility to ensure that a mortar bed or floor base that creates the slope to lay the tiles has the proper slope(s) and no low spots where water can collect. Challenges also arise when the drain is an existing drain that must be replaced, height adjusted, or referenced as a benchmark to match a new tile surface.

Accordingly, there is a need for a flooring system that incorporates certain design improvements over other systems for streamlined and improved installation of a sloped or tile floor.

BRIEF DESCRIPTION OF THE DRAWINGS

These and other features, aspects, and advantages of the present disclosure will become better understood regarding the following description, appended claims, and accompanying drawings.

Figure 1:
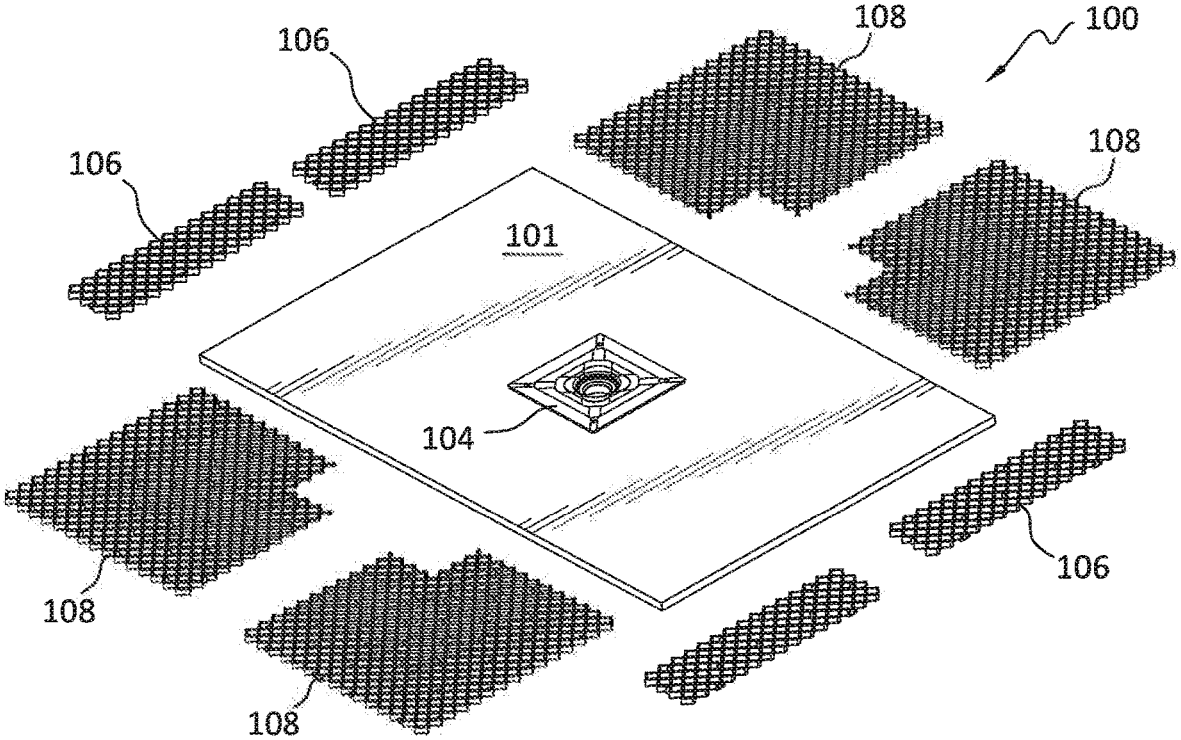
FIG. 1 is an exploded perspective view of a flooring system according to an embodiment.

The drawing figures are not necessarily drawn to scale, but instead are drawn to provide a better understanding of the components, and are not intended to be limiting in scope, but to provide exemplary illustrations. The figures illustrate exemplary configurations of drain systems, and in no way limit the structures or configurations of a drain system and components according to the present disclosure.

DETAILED DESCRIPTION OF VARIOUS EMBODIMENTS

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, there is no intention to limit the disclosure to the specific embodiments disclosed, but on the contrary, the intention covers all modifications, alternative constructions, combinations, and equivalents falling within the spirit and scope of the disclosure.

It will be understood that unless a term is expressly defined in this application to possess a described meaning, there is no intent to limit the meaning of such term, either expressly or indirectly, beyond its plain or ordinary meaning.

Embodiments of the present disclosure advantageously provide flooring systems that incorporate certain design improvements over other systems for streamlined and improved installation of a sloped or tiled floor. FIGS. 1-6 illustrate a flooring system 100 including a gridwork 102 having a modular configuration that creates a grid with cells 110 for receiving a filler material (e.g., mortar) which forms a bed or floor base sloping toward a drain fixture 104. The gridwork 102 is can be positioned on an underlying base 101 or substrate such a subfloor (e.g., a wood floor, a concrete floor, or a sloped mortar base).

Figure 2:
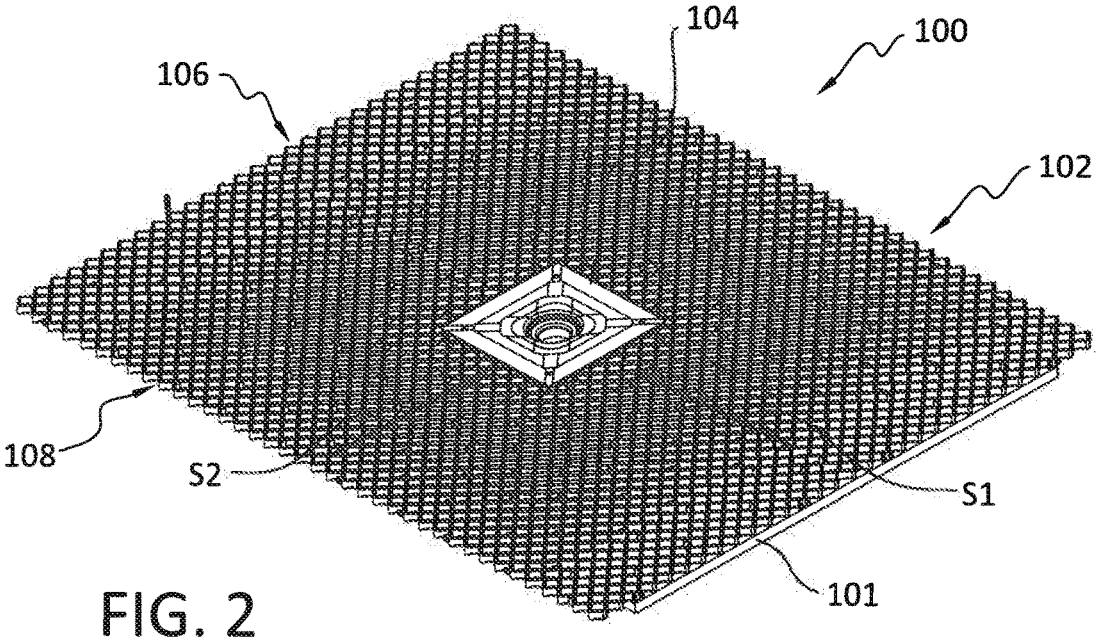
FIG. 2 is top perspective view of the flooring system in FIG. 1.

Referring to FIGS. 1 and 2, the gridwork 102 includes a plurality of grid extension panels 106 extending from a plurality of grid slope panels 108 surrounding the drain fixture 104. The grid extension panels 106 and the grid slope panels 108 collectively define the gridwork 102, with structural walls 126 or ribs and the cells 110 (best shown in FIG. 5) defined in the panels 106, 108 by the structural walls 126 and arranged as voids, compartments, or spaces for receiving the filler material. The cells 110 can take on a variety of shapes including, but not limited to, square, diamond, triangular, or rectangular. According to a variation, the gridwork 102 can have a thickness that varies to strengthen and reduce the weight of the gridwork 102. For instance, the structural walls 126 can be thinner than the junctions 111 connecting the cells 110. This reduced thickness of the structural walls 126 between the junctions 111 can reduce weight and manufacturing costs of the gridwork 102. The increased thickness of the gridwork 102 at the junctions 111 can help strengthen and support the gridwork 102 against collapse after installation.

The grid extension panels 106 and/or grid slope panels 108 can be formed in discrete sections that are pieced together to form the gridwork 102. As such, the size and shape of the gridwork 102 can be varied to fit different sizes and shapes of work areas. In an embodiment, the structural walls 126 defining the cells 110 extend and cross diagonally within the gridwork 102. For instance, the structural walls 126 defining the cells 110 may not extend normal a floor drain opening within the gridwork 102. In an embodiment, the cells 110 can be turned or oriented at a skew angle such as about 45 degrees within the gridwork 102. This beneficially helps align and connect the grid slope panels 106 and the grid extension panels 108 after either have been cut. It also helps the outer periphery of a panel capture substrate fill material. For example, the substrate fill material can be captured within open triangular openings defined by cut cells 110, which, in turn, helps the substrate fill material more effectively bridge between the panels 106, 108 and a vertical wall and/or each other. It also helps prevent the substrate fill material from migrating along the terminal edge of the panel.

The gridwork 102 is preferably made of PP (Polypropylene) but can be made of ABS (Acrylonitrile butadiene styrene), PVC (Poly Vinyl Chloride), or any other suitable material. This allows the gridwork to be altered onsite by an installer using commonly available tools. The gridwork 102 can have a flexibility as described herein and enough rigidity to avoid undesirable collapsing during use.

Figure 3:
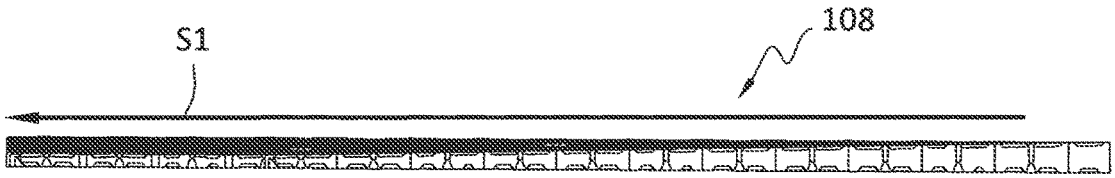
FIG. 3 is side view of the grid slope panel in FIG. 1.
Figure 4:
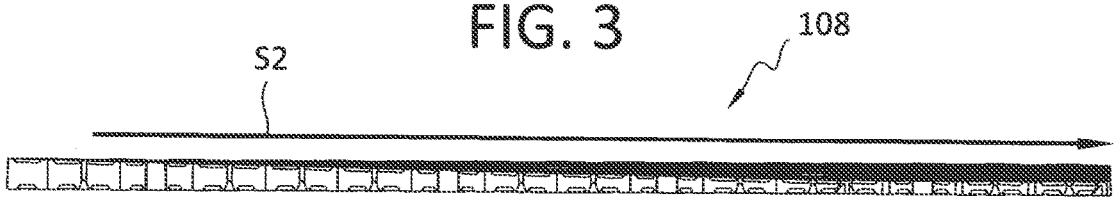
FIG. 4 is another side view of the grid slope panel in FIG. 1.

In an embodiment, each of the grid slope panels 108 has a varying height to define a drainage slope in a mortar bed for directing water towards the drain fixture 104. In an embodiment, each of the grip slope panels 108 can define a dual or diagonal slope that slopes in at least two directions toward the drain fixture 104. For instance, each grip slope panel 108 defines a first slope running in a first direction S1 toward the drain fixture 104 as shown in FIG. 3, and a second slope running in a second direction S2 that is orthogonal to the first direction as shown in FIG. 4. Both the first and second slopes can run toward the drain fixture 104. The grid extension panels 108 can have a generally constant height or parallel upper and lower surfaces.

Figure 5:
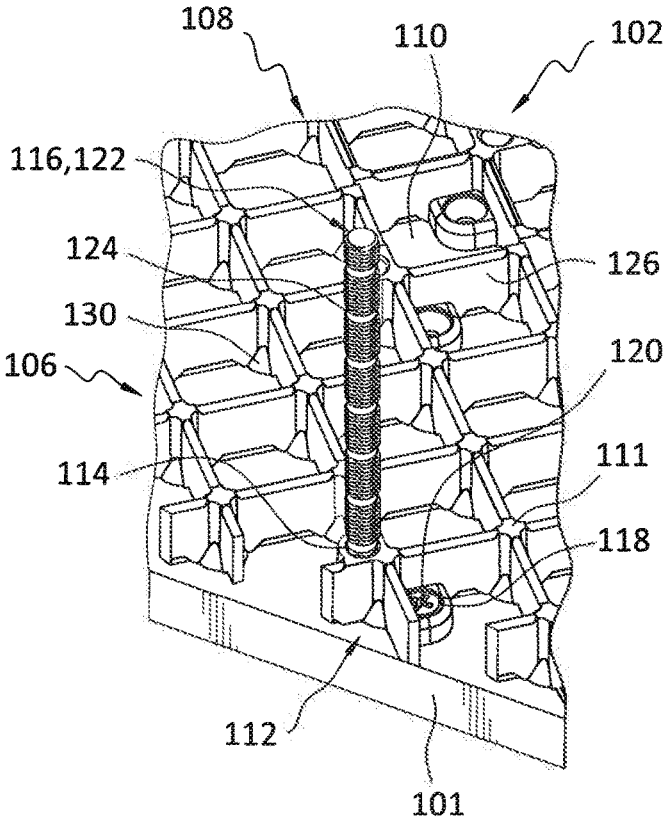
FIG. 5 is a detailed perspective view of the gridwork in FIG. 1.
Figure 6:
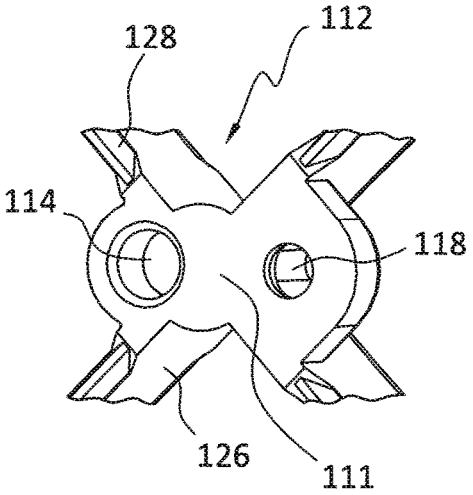
FIG. 6 is a detailed bottom perspective view of a grouping of leveling holes in FIG. 1.

Referring to FIGS. 5 and 6, the grid slope panels 108 and/or the grid extension panels 106 can include different groupings of leveling holes 112 located at selected junctions 111 between adjacent cells 110. The leveling holes 112 can help the gridwork 102 define a proper slope in the mortar bed for directing or draining water towards the drain fixture 104 if a portion of the underlying base 101 has a slope or surface that is irregular or problematic.

Each grouping of leveling screw holes 112 can include an adjustment hole 114 that can receive a height-adjusting member 116 to reposition or lift the grid extension panel 106 or the grid slope panel 108 relative to the underlying base 101, and an attachment hole 118 that receives a fastener 120 for attaching the grid extension panel 106 or the grid slope panel 108 to the underlying base 101. The leveling holes 112 can facilitate attachment of the gridwork 102 to the underlying base 101 or substrate. For instance, the attachment holes 118 provide logical screw locations for use over wood floors where the attachment holes 118 can be easily seen and used. The leveling holes 112 can be located in opposite corners within at least some of the cells 110. For instance, an adjustment hole 114 can be located in a lower, left corner of one cell 110 and an attachment hole 118 can be located in an upper, right corner of an adjacent cell 110 so that the adjustment hole 114 and the attachment hole 118 are opposite one another at a junction between the two cells.

According to a variation, the adjustment hole 114 and the attachment hole 118 can have different diameters. This can help prevent an installer from inadvertently inserting the height-adjusting member 116 or the fastener 120 in the wrong hole. In an embodiment, a limited or entire length of the adjustment hole 114 may include threads arranged to engage with the height adjusting member 116. For instance, a lower portion of the adjustment hole 114 can include internal threads arranged to engage with the height-adjusting member 112 having external threads along a length thereof. A limited or entire length of the attachment hole 118 may include threads arranged to engage with the fastener 120.

In use, the attachment hole 118 can receive the fastener 120 to pull toward and attach the grid extension panel 106 or the grid slope panel 108 to the underlying base 101 or substrate. The adjustment hole 114 can receive the height-adjusting member 116 comprising a set screw or threaded member that can be manipulated in the adjustment hole 114 to tilt or adjust the position of the grid extension panel 106 or the grid slope panel 108 relative to the underlying base 101. More particularly, with the fastener 120 securing the grid extension panel 106 or the grid slope panel 108 to the underlying base 101, the height-adjusting member 116 can be manipulated to raise or lower the panels 106 or 108 at the junction 111 between adjacent cells 110. As the height-adjusting member 116 forces the panel 106 or 108 up or down relative to the underlying base 101, the panel 106 or 108 can flex or bend in the area of the leveling holes 112, which, in turn, can tilt or adjust the position of the grid extension panel 106 or the grid slope panel 108 relative to the underlying base 101.

This beneficially allows an installer to adjust the height and/or angle of the gridwork 102 at different locations to ultimately help bring the top surface of mortar applied to the gridwork 102 to the proper grade and smoothness, reducing the likelihood of puddling. For instance, if the underlying base 101 is uneven or irregular, an installer can manipulate different height-adjusting members 116 to raise or lower the grid extension panels 106 where the underlying base 101 is uneven or irregular to help bring the top surface of the mortar to the proper grade and smoothness when it is applied to the gridwork 102. Moreover, the installer can do this without the need of using shims or other labor intensive and imprecise practices commonly employed by tile installers.

As seen, the adjustment holes 114 and the attachment holes 118 can be offset along a height of the grid extension panels 106 or grid slope panels 108. This helps the panels 106, 108 distribute forces and flex, bend, or angle relative to the attachment holes 118 when the grid extension panel 106 or grid slope panel 108 is attached to the underlying base 101. In an embodiment, the attachment holes 118 can be shortened or formed in a web portion toward the bottom of the panels 106, 108, helping to securely anchor the panels 106, 108 to the underlying base 101. The adjustment holes 114 can have a height greater than the height of the web portion. The adjustment holes 114 extend in a direction upwardly from the attachment holes 118 along structural walls 126, helping the height-adjustment member 116 member to force movement of the panels 106, 108 beyond the connection of the panels 106, 108 to the underlying base 101 at the attachment holes 118. In an embodiment, the height of the adjustment holes 114 can generally correspond to the height or thickness of the structural walls 126.

According to a variation, the height-adjusting member 116 comprises a threaded plastic rod 122 with breakpoints 124 such that the rod 122 can be broken off and left in place within the adjustment hole 114, allowing the length of the rod 122 to be adjusted as needed. In other embodiments, the breakpoints 124 can be omitted and the rod 122 can be sheared or cut off by any suitable method at the upper surface of the gridwork 102 and left in place in the adjustment hole 114.

In one exemplary installation process, the drain fixture 104 and the gridwork 102 can be placed in position relative to the underlying base 101. In placing the drain fixture 104, the drain fixture 104 can be attached to a drain pipe or other underdrain structure, and a support frame carrying a construction plug can be positioned over the drain opening of the drain fixture 104. The gridwork 102 is placed and secured to the underlying base 101. The grid extension panels 106 can be sized and shaped to fit the surface of the underlying base 101, and the height and/or angle of the grid extension panels 106 and the grid slope panels 108 can be adjusted via the leveling holes 112 to create the proper grade with the gridwork 102.

Figure 7:
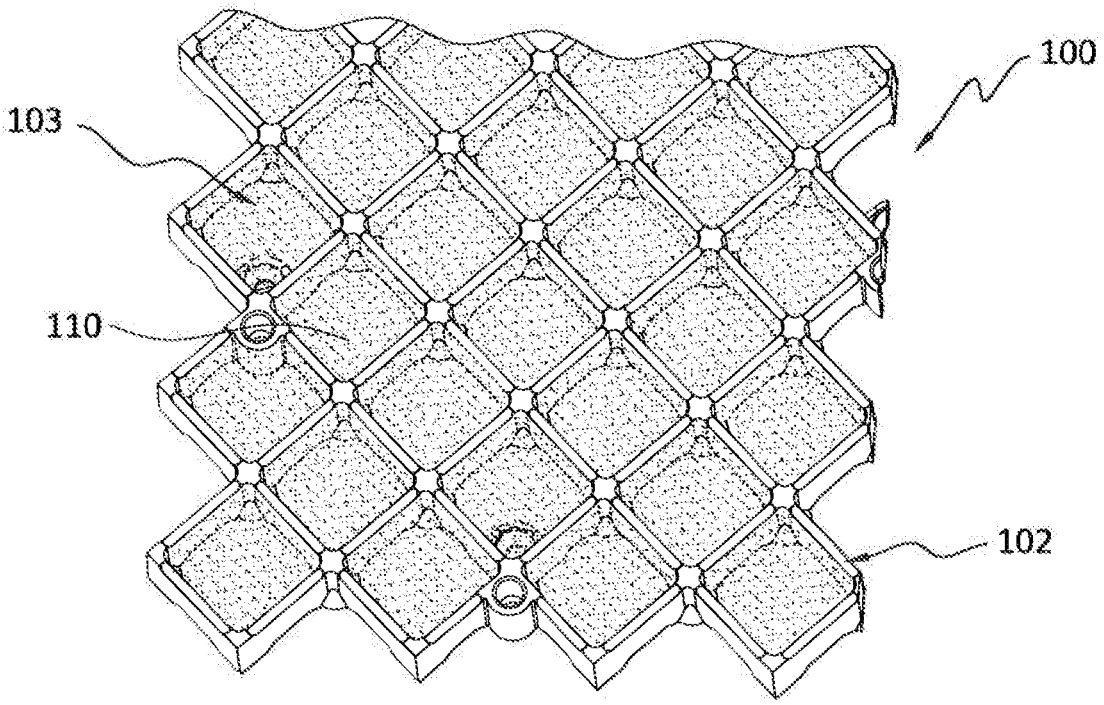
FIG. 7 is a perspective view of a substrate according to an embodiment.

Once the gridwork 102 is secured to and positioned on the underlying base 101, a cementitious or mortar material can then be applied to the gridwork 102 to build a mortar bed up to the upper surface of the drain fixture 104, forming the appropriate slope towards the drain opening of the drain fixture 104. For instance, an installer can trowel the mortar material over the gridwork 102 to form the mortar bed. An exemplary segment 103 of such a mortar bed is shown in FIG. 7.

As noted above and shown in FIG. 7, the cells 110 receive the mortar material as the mortar material is applied to and/or spread over the gridwork 102 to form a substrate. Structural walls 126 of the panels 106 108 define the cells 110 and physically separate the mortar material in one cell 110 from another. This physical separation has the effect of isolating stresses in the mortar material in one cell 110 from another, which, in turn, beneficially limits or greatly reduces undesirable fracturing or cracking of the mortar bed. For instance, the development of a crack in the mortar material in one cell 110 is isolated from the mortar material in the adjacent cell by the structural walls 126 such that the maximum length of a continuous crack within a finished mortar bed incorporating the gridwork 102 is generally limited to the greatest lateral dimension of the individual cell 110.

For instance, the cells 110 can help ensure that cracking of a substrate fill material applied to the gridwork 102 is limited to micro-cracks. In use, the grid or panels 106, 108 divide and capture cementitious or mortar material in the cells 110 defining small modules in the gridwork 102. The geometry of each cell 110 restricts the material from moving vertically or laterally. This cellular division provides a strong proportional shape to each cell 110 or module, reducing the likelihood of cracking within a cell 110. In practice, a compulsion among installers is to not allow enough cure time of the cementitious or mortar material before advancing to the next installation step, which is often painting on a liquid waterproofing membrane or the like. Because these fill materials tend to shrink as they cure and because they are applied in a varying sloped configuration over an uncontrolled substrate or underlying base where bonding characteristics vary, cracks generally form within a week following application. If an installer chooses to apply a liquid waterproofing to the top surface of the fill material before the area is fully cured and stabilized, the installer will unlikely be aware that open cracks have formed and propagated from the filled area up through the topical waterproofing layer. Painted-on coatings generally do not have enough elasticity to bridge much of a gap at all.

The gridwork 102 helps insure that cracking of the substrate fill is limited to micro-cracks that a coating can bridge over. In an embodiment, the upper end of the structural walls 126 can include a radiused or rounded configuration, helping the substrate fill material to hide or cover the structural walls 126 as the substrate fill material is spread over the top of the gridwork 102. According to a variation, the radiused configuration can extend along the structural walls between the junctions 111 but can be omitted at the junctions 111 themselves. This enhanced coverage of the gridwork 102 by the substrate fill material can help strengthen the bond between painted-on coatings and the substrate (which is generally more porous or hydrophilic than the structural walls). This also can help eliminate or reduce the likelihood of hard or disruptive edges formed by the structural walls 126 in the top surface of the substrate.

According to a variation, a bottom portion of one or more of the structural walls 126 define a first locking feature 128 that helps cementitious or mortar material mechanically lock with the gridwork 102 as best shown in FIG. 6. The first locking feature 128 can comprise an undercut at the bottom of the structural wall 126 or any other suitable feature. This undercut can help capture cementitious or mortar material under the structural wall 126 within the undercut, which, in turn, helps secure the gridwork 102 in the material as it sets.

According to another variation, a bottom portion of at least some of the ribs or structural walls 126 can include a second locking feature 130 that helps attach the gridwork 102 to an underlying base or substrate that is not ideal for receiving screws or other fasteners via the attachment holes. For instance, if the underlying base or substrate is a concrete slab it may be difficult to utilize the attachment holes 118 to attach the gridwork 102 to the substrate. In such an application, the second locking feature 130 can comprise a protrusion having a conical or other shape configured to be imbedded into a layer of thinset mortar or other bonding material. In use, thinset can be first applied over the concrete slab. The thinset will set up as moisture from the thinset is absorbed into the slab. Next, the gridwork 102 is set in the thinset while the thinset is still wet. At each intersection or junction 111 of the gridwork 102, the thinset will wrap itself over the protrusion or its perimeter and capture the protrusions and the gridwork 102, attaching the gridwork 102 to the concrete slab. The second locking features 130 help attach the gridwork 102 to substrates such as concrete slabs or the like.

After the thinset has set up, the gridwork 102 is filled with a cementitious or mortar material to form a substrate as such a mortar bed as described herein. It will be appreciated that a mortar bed is exemplary only, and other possible substrates exist. In other embodiments, a shower pan can be placed between the gridwork 102 and the underlying base 101.

Thinset mortar can be spread over the top of the mortar bed and floor tiles can be set in the thinset mortar. The thinset mortar can be applied such that a small gap remains between the support frame and the thinset mortar. Once the thinset mortar is dried, the set tiles can be grouted with the temporary construction plug in place. After grouting, the installer can remove the temporary construction plug and install a drain cover or frame in the support frame and the drain fixture is ready for use.

The flooring system 100 can thus allow for easier and faster installation of tile floors that are more appealing than existing systems and which exhibit improved hydraulic properties. While each grouping of leveling holes 112 is shown including a single attachment hole and a single adjustment hole, it will be appreciated that other configurations are possible. For instance, in other embodiments, the groupings can include two adjustment holes and a single attachment hole. In other embodiments, the groupings can include three adjustment holes and a single attachment hole. In other embodiments, the groupings can include two adjustment holes and two attachment holes.

In other embodiments, the connection type between the height-adjusting member 116 and the adjustment holes 114 can be different. For instance, the height-adjusting member 116 can comprise a worm-drive and the adjustment holes 114 can define slots that interact with the worm-drive to drive upward and/or downward movement of the panels 106, 108 relative to the underlying base 101. In other embodiments, a ratchet-type connection with a release mechanism can be formed between the height-adjusting member 116 and the adjustment holes 114 that drives upward and/or downward movement of the panels 106, 108 relative to the underlying base 101.

Figure 8:
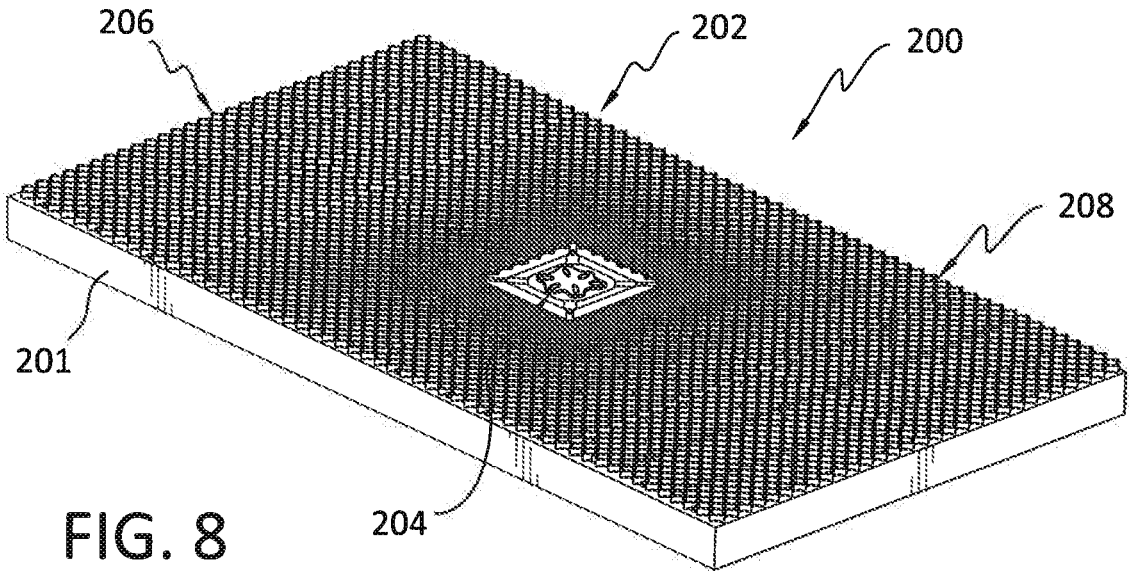
FIG. 8 is a top perspective view of a flooring system according to another embodiment.

FIG. 8 illustrates a flooring system 200 according to yet another embodiment including a gridwork 202 having a modular configuration that creates a grid for receiving a filler material which forms a bed or floor base sloping toward a drain fixture 204. The gridwork includes a plurality of grid extension panels 206 and a plurality of slope panels 208 surrounding the drain fixture 204. As in previous embodiments, the configuration of the gridwork 202 includes a plurality of cells and different sets of leveling holes located at selected junctions between adjacent cells. These features help the gridwork 202 adjust to define a proper slope in a sloped floor for directing or draining water towards the drain fixture 204.

As seen, the grid slope panels 208 are formed in discrete sections that are pieced together to form the gridwork 202. The panels 206, 208 can be customized to fit different work areas. For instance, the grid extension panels 206 are sized differently than in the previous embodiment to correspond to the size and rectangular shape of an underlying base 201. In addition, the grid slope panels 208 are cut to fit a drain fixture 204 with a support frame and a drain cover 204 having a hexagonal shape.

Figure 9:
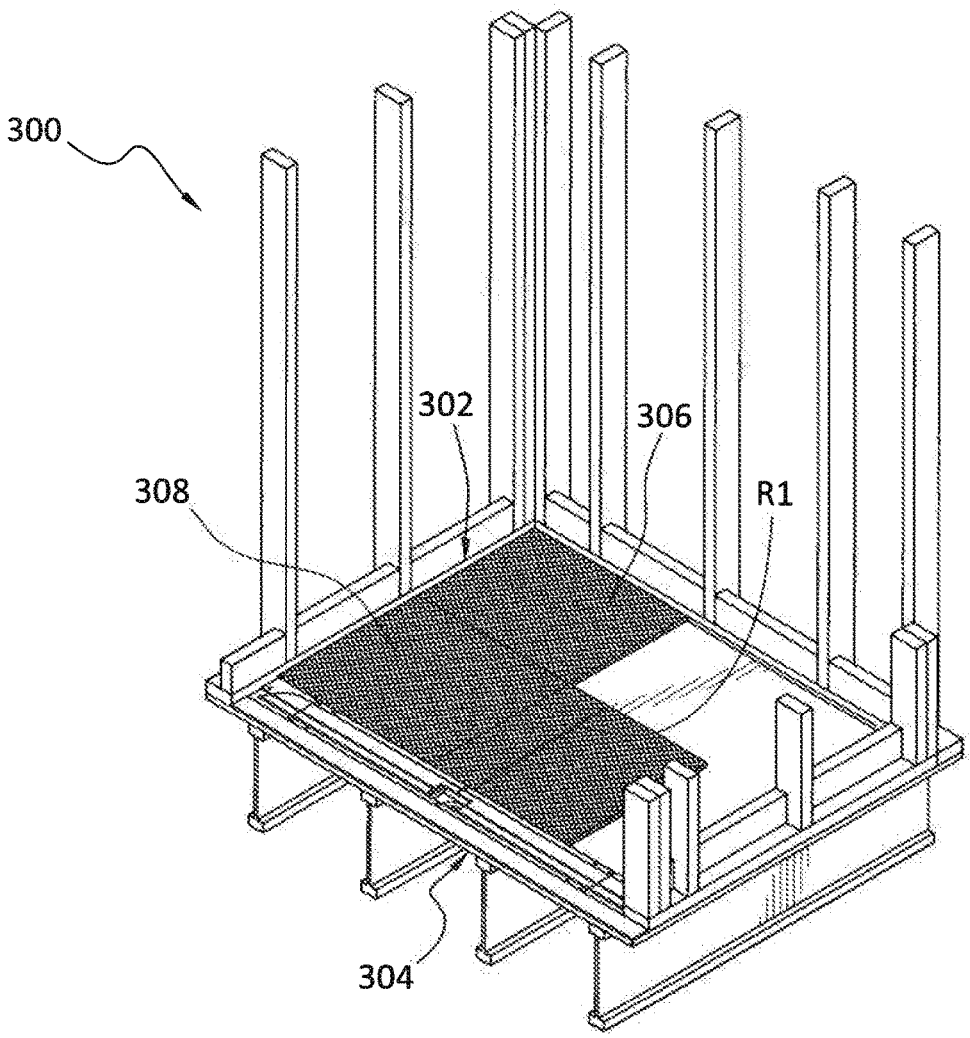
FIG. 9 is a top perspective view of a flooring system according to another embodiment.
Figure 10:
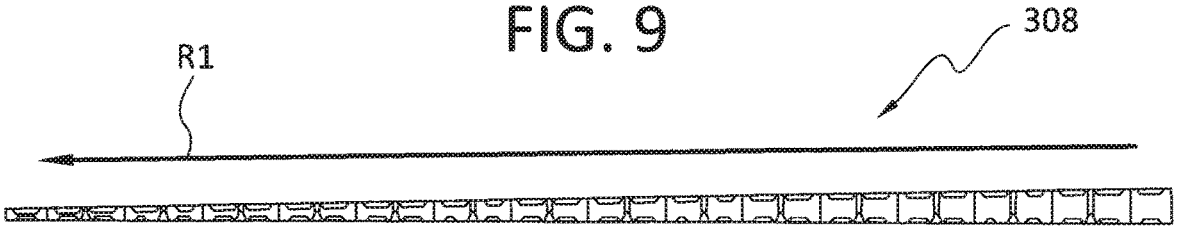
FIG. 10 is a side view of a grid slope panel in FIG. 9.
Figure 11:
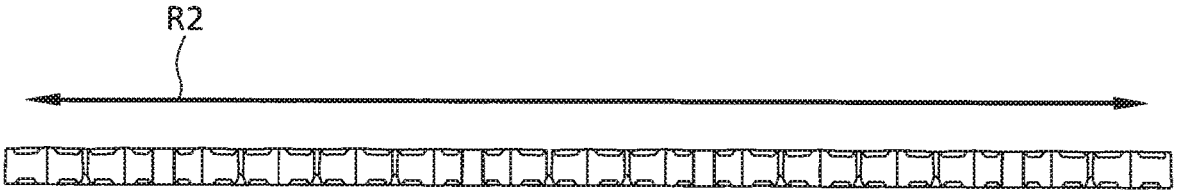
FIG. 11 is another side view of a grid slope panel in FIG. 9.

FIGS. 9-11 illustrate a flooring system 300 according to yet another embodiment including a gridwork 302 having a modular configuration that creates a grid with cells for receiving a filler material which forms a bed or floor base sloping toward a drain fixture 304. The gridwork 302 includes a plurality of grid extension panels 306 and a plurality of grid slope panels 308 surrounding the drain fixture 304.

In the illustrated embodiment, the drain fixture 304 comprises a linear drain arranged to extend substantially across an entire tile floor and located toward a wall or along an entryway to a shower or tile floor area. As such, rather than defining a dual slope, the grid slope panels 308 define a single slope that slopes in a single direction toward the drain fixture 304. For instance, each grid slope panel 308 defines a first slope running in a first direction R1 toward the drain fixture 304 as shown in FIG. 10, and each grid slope panel 308 can have a generally constant height or parallel upper and lower surfaces running in a second direction R2 that is orthogonal to the first direction R1 as shown in FIG. 11. The grid extension panel 306 can be flat. Thus, the gridwork 302 can be varied for different types of drain installations.

As in previous embodiments, the configuration of the gridwork 302 includes cells and different sets of leveling holes located at selected junctions between adjacent cells. These features help the gridwork 302 adjust to define a proper slope in a sloped floor for directing or draining water towards the drain fixture 304.

The various aspects and embodiments disclosed herein are for purposes of illustration and are not intended to be limiting. Additionally, the words "including," "having," and variants thereof (e.g., "includes" and "has") as used herein, including the claims, shall be open-ended and have the same meaning as the word "comprising" and variants thereof (e.g., "comprise" and "comprises").

The invention claimed is:

1. A flooring system comprising:

a gridwork having a modular configuration that defines a grid with cells for receiving a filler material which forms a bed or floor base sloping toward a drain fixture, the gridwork including different groupings of leveling holes located at selected junctions between adjacent cells that are arranged to selectively move or tilt the gridwork relative to an underlying base in conjunction with a formation of the bed or floor base.

2. The flooring system of claim 1, wherein at least one grouping of leveling holes includes an adjustment hole arranged to threadedly receive a height-adjusting member to reposition or lift localized areas of the gridwork relative to the underlying base.

3. The flooring system of claim 2, wherein the height-adjusting member comprises a threaded member.

4. The flooring system of claim 2, wherein the at least one grouping of leveling holes includes an attachment hole arranged to receive a fastener for attaching the localized areas of the gridwork to the base.

5. The flooring system of claim 4, wherein the attachment hole is configured to pull the gridwork toward the underlying base and the adjustment hole is configured to push the gridwork away from the underlying base.

6. The flooring system of claim 2, wherein the gridwork is configured so that when the height-adjusting member forces the gridwork up relative to the underlying base the gridwork flexes in the area of the leveling holes.

7. The flooring system of claim 4, wherein the attachment hole and the adjustment hole have different diameters.

8. The flooring system of claim 4, wherein the attachment hole and the adjustment hole are offset along a thickness of the gridwork.

9. The flooring system of claim 4, wherein the attachment hole and the adjustment hole are opposite one another at least one of the selected junctions.

10. The flooring system of claim 1, wherein the gridwork includes a plurality of grid extension panels extending from a plurality of grid slope panels surrounding the drain fixture.

11. The flooring system of claim 10, wherein the grid slope panels and the grid extension panels are formed in discrete sections and pieced together to form the gridwork.

12. The flooring system of claim 10, wherein the grid slope panels slope in a single direction.

13. The flooring system of claim 10, wherein the grid slope panels slope in at least two directions.

14. The flooring system of claim 12, wherein the grid slope panels slope in a first direction and a second direction orthogonal to the first direction.

15. The flooring system of claim 1, further comprising a plurality of protrusions formed toward a bottom of the gridwork, the protrusions configured to be imbedded in a cementitious or mortar material.

16. The flooring system of claim 1, further comprising a plurality of undercuts formed along a bottom of the gridwork, the undercuts configured to capture cementitious or mortar material under the gridwork.

17. A flooring system comprising:

a gridwork having a modular configuration that defines a grid with cells for receiving a filler material which forms a bed or floor base sloping toward a drain fixture, the gridwork including different groupings of leveling holes located at selected junctions between adjacent cells that are arranged to selectively move or tilt the gridwork relative to an underlying base in conjunction with the formation of a bed or floor base, wherein the gridwork includes a plurality of grid extension panels extending from a plurality of grid slope panels surrounding the drain fixture.

18. The flooring system of claim 17, wherein the grid slope panels and the grid extension panels are formed in discrete sections and pieced together to form the gridwork.

19. The flooring system of claim 17, wherein the grid slope panels slope in a single direction.

20. A flooring system comprising:

a gridwork having a modular configuration that defines a grid with cells for receiving a filler material which forms a bed or floor base sloping toward a drain fixture, the gridwork including different groupings of leveling holes located at selected junctions between adjacent cells that are arranged to selectively move or tilt the gridwork relative to an underlying base in conjunction with the formation of a bed or floor base, wherein the gridwork includes a plurality of grid extension panels extending from a plurality of grid slope panels surrounding the drain fixture, and the cells are turned about 45 degrees relative to a longitudinal axis of the gridwork.

* * * * *